US009719201B2

(12) United States Patent
Jackson et al.

(10) Patent No.: US 9,719,201 B2
(45) Date of Patent: Aug. 1, 2017

(54) LAUNDRY MACHINE

(71) Applicant: Fisher & Paykel Appliances Limited, Auckland (NZ)

(72) Inventors: Russell Joseph Jackson, Auckland (NZ); Adam Peter Johnson, Auckland (NZ)

(73) Assignee: Fisher & Paykel Appliances Limited (NZ)

( * ) Notice: Subject to any disclaimer, the term of this patent is extended or adjusted under 35 U.S.C. 154(b) by 28 days.

(21) Appl. No.: 14/654,012

(22) PCT Filed: Dec. 20, 2013

(86) PCT No.: PCT/NZ2013/000243

§ 371 (c)(1),
(2) Date: Jun. 19, 2015

(87) PCT Pub. No.: WO2014/098626

PCT Pub. Date: Jun. 26, 2014

(65) Prior Publication Data

US 2016/0215437 A1 Jul. 28, 2016

Related U.S. Application Data

(60) Provisional application No. 61/740,728, filed on Dec. 21, 2012.

(51) Int. Cl.
*D06F 37/20* (2006.01)
*D06F 39/00* (2006.01)
(Continued)

(52) U.S. Cl.
CPC ..... *D06F 37/20* (2013.01); *D06F 37/203* (2013.01); *D06F 39/003* (2013.01);
(Continued)

(58) Field of Classification Search
CPC ..... D06F 37/20; D06F 37/203; D06F 39/003; D06F 39/125; D06F 58/06; D06F 58/20; D06F 2222/00
See application file for complete search history.

(56) References Cited

U.S. PATENT DOCUMENTS 6,983,657 B1 1/2006 Kabutani et al.
7,089,800 B2 * 8/2006 Kakutani ..... D06F 37/24 73/779
(Continued)

FOREIGN PATENT DOCUMENTS

DE 19857663 6/1999
DE 19949217 A1 10/1999
(Continued)

OTHER PUBLICATIONS

Machine translation of DE 19949217 A1, no date.*
(Continued)

*Primary Examiner* — Joseph L Perrin
(74) *Attorney, Agent, or Firm* — Timothy M. McCarthy; Clark Hill PLC

(57) ABSTRACT

A laundry machine comprising a dynamically suspended assembly including a drum for holding laundry, rotationally mounted with the dynamically suspended assembly, a supporting structure for the dynamically suspended assembly, and at least one suspension assembly coupled between the dynamically suspended assembly and the supporting structure for supporting the dynamically suspended assembly, with a load sensor between the suspension assembly and the supporting structure or between the suspension assembly and the dynamically suspended assembly.

12 Claims, 4 Drawing Sheets

(51) Int. Cl.

| | |
|---|---|
| ***D06F 58/06*** | (2006.01) |
| ***D06F 58/20*** | (2006.01) |
| ***D06F 39/12*** | (2006.01) |

(52) U.S. Cl.

CPC ..... *D06F 39/125* (2013.01); *D06F 58/06* (2013.01); *D06F 58/20* (2013.01); *D06F 2222/00* (2013.01)

(56) References Cited

U.S. PATENT DOCUMENTS

| | | | | |
|---|---|---|---|---|
| 7,293,313 | B2 | 11/2007 | Beier et al. | |
| 2006/0048549 | A1* | 3/2006 | Matsukura | D06F 37/203 68/12.06 |
| 2006/0053838 | A1* | 3/2006 | Inuzuka | D06F 33/02 68/3 R |
| 2006/0053839 | A1 | 3/2006 | Matsushima et al. | |
| 2007/0068258 | A1* | 3/2007 | Lee | G01H 11/06 73/660 |
| 2010/0251487 | A1 | 10/2010 | Bolduan et al. | |
| 2011/0113567 | A1* | 5/2011 | Lee | D06F 39/003 8/137 |

FOREIGN PATENT DOCUMENTS

| | | | |
|---|---|---|---|
| DE | 29812393 | U1 | 11/1999 |
| DE | 19842611 | | 11/2000 |
| DE | 19952464 | | 5/2002 |
| EP | 0546379 | A1 | 11/1992 |
| EP | 2322705 | A1 | 5/2011 |
| WO | WO-2012/089442 | A1 | 7/2012 |

OTHER PUBLICATIONS

International Search Report , International Application No. PCT/NZ/2013/000243.

Written Opinion of the International Preliminary Examining Authority, International Application No. PCT/NZ/2013/000243, dated Jan. 12, 2015.

International Preliminary Report on Patentability, International Application No. PCT/NZ/2013/000243, dated Apr. 28, 2015.

European Search Report, dated Aug. 1, 2016.

Patent Examination Report, dated May 29, 2015, Patent Application No. 2013/204355, pp. 1-3.

* cited by examiner

LAUNDRY MACHINE

This application is a National Phase filing of PCT/NZ2013/000243, having an International filing date of Dec. 20, 2013, which claims priority to U.S. Patent Application Ser. No. 61/740,728, which was filed on Dec. 21, 2012. The disclosures of the foregoing are hereby incorporated by reference.

FIELD OF THE INVENTION

The invention relates to laundry machines comprising a load sensor or sensors associated with one or more suspension units which dynamically support a drum assembly of the laundry machine.

BACKGROUND TO THE INVENTION

It is an object of the present invention to provide an improved laundry machine, or to at least provide the public or industry with a useful choice.

SUMMARY OF THE INVENTION

In broad terms in one aspect the invention consists in a laundry machine comprising:

- a dynamically suspended assembly including a drum for holding laundry, rotationally mounted with the dynamically suspended assembly,
- a supporting structure for the dynamically suspended assembly, and
- at least one suspension assembly coupled between the dynamically suspended assembly and the supporting structure for supporting the dynamically suspended assembly, and
- a load sensor between the suspension assembly and the supporting structure or between the suspension assembly and the dynamically suspended assembly.

In at least some embodiments the load sensor is responsive substantially only to vertical force or a vertical component of force thereon.

Some embodiments comprise a pivot joint between the suspension assembly and the supporting structure, or between the suspension assembly and the suspended assembly, and the load sensor is associated with the pivot joint. In some embodiments an end of the suspension assembly bears on a pivot arm mounted about an axis transverse to a compression axis of the suspension unit, to one side of the suspension assembly.

In some embodiments the end of the suspension assembly is coupled to the support structure by a ball joint. In some embodiments an end of the suspension assembly comprises a ball mounted in a socket in a pivot arm mounted about an axis to one side of the ball joint transverse to a compression axis of the suspension assembly.

In other embodiments the pivot joint comprises a flexible elastomeric joint element. The laundry machine may comprise two, three, or four or more suspension assemblies, one or more or all of which comprise a load sensor between the suspension assembly and the supporting structure.

The laundry machine may be a washing machine, and the dynamically suspended assembly may comprise a tub for holding washing fluid and a perforated drum rotationally mounted within the tub, and the suspension assembly or assemblies is/are coupled between the tub and the supporting structure for supporting the dynamically suspended assembly, the suspension assembly coupled to the supporting structure below the tub. For example, the laundry machine is a horizontal axis washing machine. The laundry machine may be a top loading horizontal axis washing machine, the drum being supported at each end by a shaft rotationally supported by bearings located at the tub. Alternatively the laundry machine is a dryer.

In this specification and claims, a horizontal axis machine is a machine that has the rotating laundry drum supported so that the longitudinal axis of the drum is horizontal or at an angle of up to 45 degrees from horizontal. And a vertical axis machine is a machine that has the rotating laundry drum supported so that the longitudinal axis of the drum is vertical or at an angle of up to 45 degrees from vertical. A horizontal axis machine may be front or top loading.

The term "comprising" as used in this specification and claims means "consisting at least in part of". When interpreting each statement in this specification and provisional claims that includes the term "comprising", features other than that or those prefaced by the term may also be present. Related terms such as "comprise" and "comprises" are to be interpreted in the same manner.

The invention consists in the foregoing and also envisages constructions of which the following gives examples only.

BRIEF DESCRIPTION OF THE DRAWINGS

Embodiments of the invention will be described by way of example only and with reference to the drawings, in which.

DETAILED DESCRIPTION OF EMBODIMENTS

Figure 1:
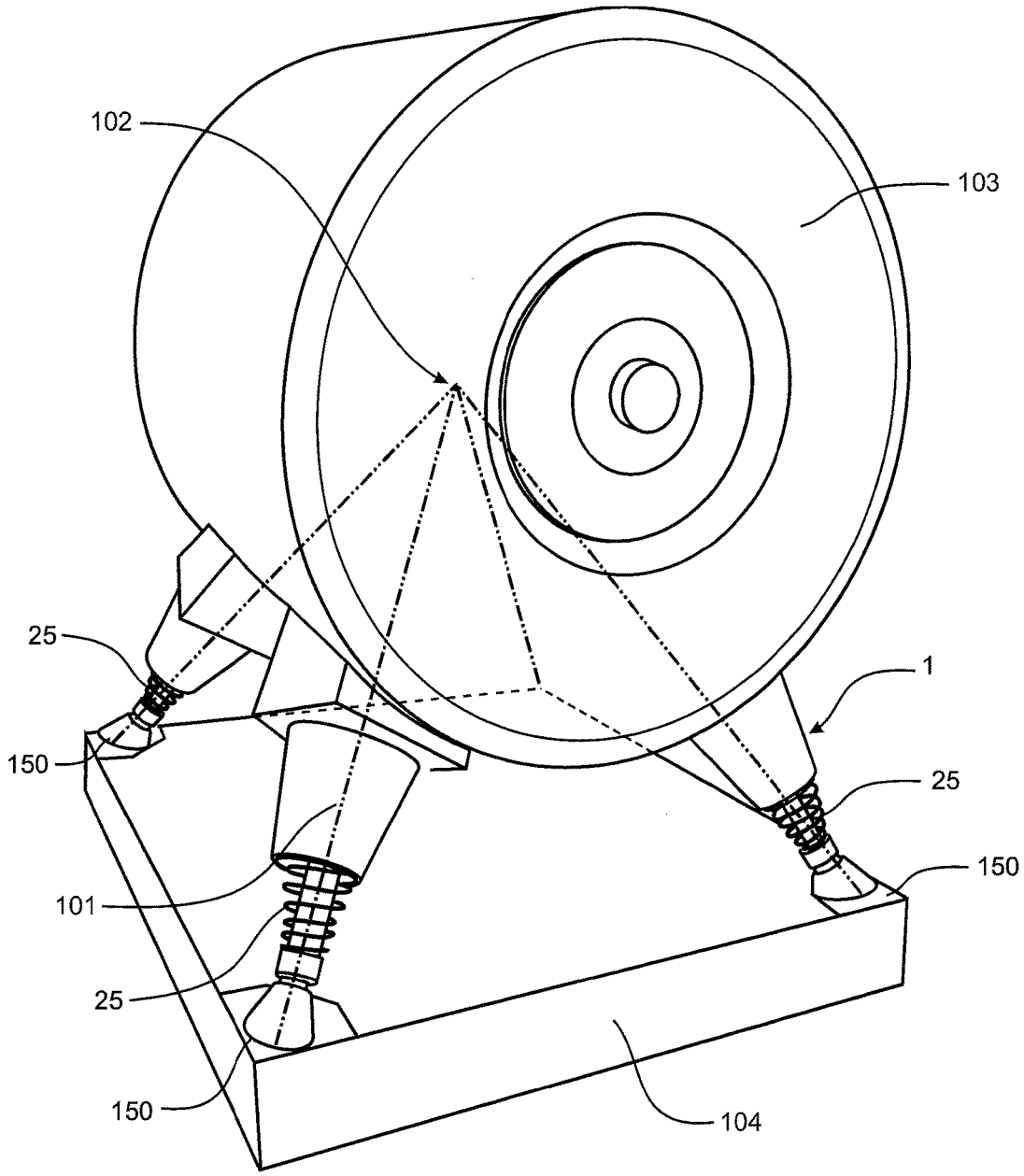
FIG. 1 shows a dynamically suspended assembly of a horizontal axis washing machine comprising a tub and a drum (not shown) rotationally mounted in the tub, the dynamically suspended assembly supported from below by four suspension units.
Figure 3:
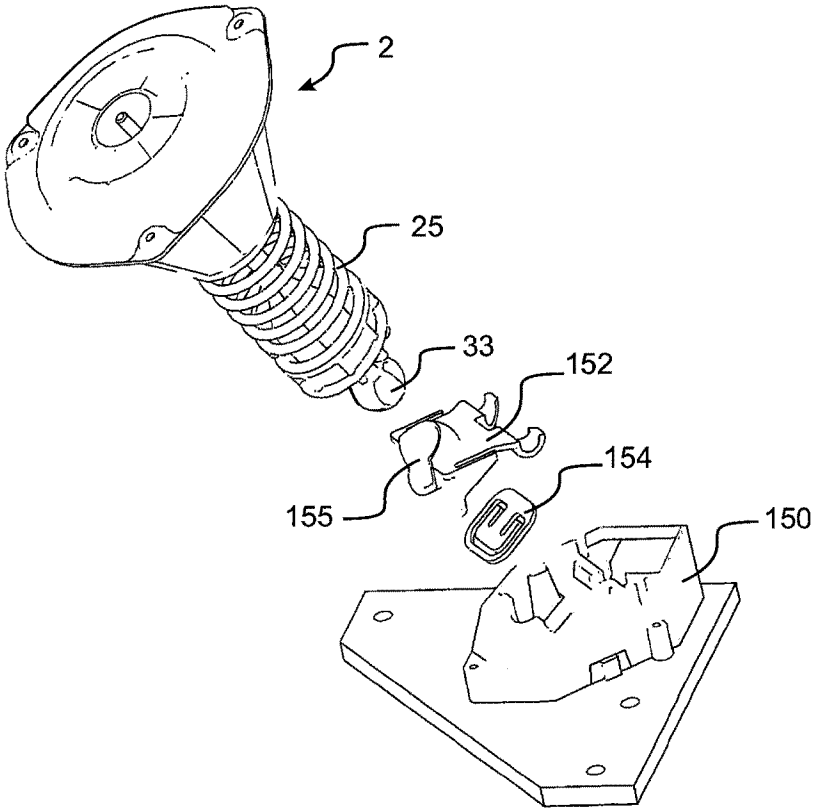
FIG. 3 is a part exploded view of the suspension unit and foot of FIG. 2.

FIG. 1 shows a horizontal axis tub and drum assembly of a laundry machine, supported from below by four suspension units 1 (one obscured from view) each angled inwardly from a base 104. Referring to FIGS. 2 to 6, each suspension unit 1 comprises a strut or shaft 5, a coupling 2 disposed toward a first or upper end of the strut for connecting to the suspended assembly of the laundry machine, and a spring 25 extending from the coupling towards a second or lower end of the strut.

In the embodiment shown the coupling 2 comprises a strut part 15 connected to the strut 5 and a mounting part 3 which is connected to the suspended assembly. The mounting part and the strut part are mutually adapted to allow the two parts to tilt or pivot with respect to each other. That is, the mounting part 3 of the coupling 2 can tilt or pivot relative to the strut 5 or the strut part 15 of the coupling, and the strut or strut part 15 of the coupling can tilt or pivot relative to the mounting part 3 of the coupling.

In this specification and claims, tilt, tilting, pivot and pivoting are used to describe movement between the strut part and the mounting part of the coupling that causes a longitudinal axis of these parts to tilt relative to one another. Pivoting or tilting movement in this specification and claims is intended to also mean rotational movement with at least one degree of freedom about a centre of rotation. Preferably the coupling 2 provides tilting or pivoting movement that allows for rotation with at least two degrees of freedom about a centre of rotation. That is, rotational movement about the centre of rotation in any lateral direction with respect to the longitudinal axis of the strut 5. Preferably the coupling 2 provides tilting or pivoting movement that allows for rotation with three degrees of freedom about a centre of rotation.

One end of the spring 25 is restrained relative to the mounting part of the coupling 2 and the other end of the spring is restrained relative to the strut 5, so that tilting movement between the parts of the coupling causes the spring to bend or deform laterally. As described above, the lateral stiffness of the spring will resist bending and lateral deflection of the spring. Thus the suspension unit arrangement uses the lateral stiffness of the spring to resist pivoting or tilting movement between the mounting part and the strut part of the coupling.

The suspension unit has a second coupling 30 at the second or lower end of the strut. The second coupling allows the suspension unit to tilt or pivot relative to a support structure or foot 150 to which the second coupling is attached and which forms part of the laundry machine. Preferably the second coupling provides at least two degrees of freedom of rotational movement between the second end of the strut and the supporting structure. Preferably the second coupling provides three degrees of freedom. Preferably the second coupling is a ball joint. As shown, ball 33 of a ball joint is attached at the end of the strut 5, and a corresponding socket 155 is provided in the foot 150.

In the preferred embodiment, the coupling 2 at the first end of the strut (the first coupling) is a pivot coupling, and preferably the second coupling 30 is a pivot coupling. Preferably the first coupling allows three degrees of freedom of rotational movement between the strut part and the mounting part of the first coupling. And preferably the second coupling allows three degrees of freedom of rotational movement between the strut part and the mounting part of the second coupling.

In an alternative embodiment, the first coupling or the second coupling or both couplings could, by example, be formed as an elastomeric block or member coupled between an end of the strut and a corresponding structure or assembly. The resiliency of the elastomeric block allows a strut part and a mounting part of the coupling to tilt relative to one another. For example, a flange for attaching the strut to the elastomeric block could be the strut part of the coupling. And a flange for attaching the elastomeric block to a tub could be the mounting part of the coupling. One embodiment requires a coupling at one end having a mounting part and a strut part, the coupling adapted to allow relative tilting movement between the strut and mounting parts, and the spring restrained relative to the mounting part of the coupling.

The suspension unit 1 allows axial movement of the strut 15 relative to the first coupling 2 at the first end of the strut or the second coupling 30 at the second end of the strut to allow the spring 30 to be compressed to absorb linear and/or axial movement of the suspended assembly relative to the supporting structure.

The suspension unit 1 may incorporate damping such as friction damping.

In accordance with the invention a load sensor is provided between the suspension assembly and the supporting structure.

In one embodiment the laundry machine comprises at least two said suspension assemblies with a load sensor between at least one suspension assembly and the supporting structure. In a preferred embodiment the laundry machine comprises at least three said suspension assemblies with a load sensor between at least one suspension assembly and the supporting structure. Most preferably, the laundry machine comprises four said suspension assemblies with a load sensor between at least one suspension assembly and the supporting structure.

Referring to FIGS. 2 to 6 a load sensor such as a load cell 154 is positioned between the suspension unit 1 and corner foot 150 which is attached to and forms part of the base structure of the laundry machine, which in turn stands on the floor through feet or pads between this base structure of the cabinet of the machine and the floor.

In the preferred embodiment shown a pivot joint is provided between suspension assembly 1 and foot 150, which is a ball joint. Ball 33 on the end of suspension assembly 1 is mounted in a socket 155 in a pivot arm 152 mounted about an axis 153 transverse to the compression axis of the suspension unit to one side of the ball joint. Load cell 154 is mounted in the foot 150 below the free end of the arm 152 comprising socket 155. As the machine operates, the angle and magnitude of force acting on the socket 155 from the suspension unit 1 varies greatly. This structure isolates the vertical force component, and provides useful load information.

Because in the embodiment shown the ball 33 centre is aligned in the same horizontal plane as the pivot axis 153, the moment generated about the pivot axis 153 is equal to the distance between the axis 153 and the ball 33 centre multiplied by the normal force (vertical component of the suspension force). The contact surface of the load cell 154 is also aligned with pivot axis 153 and the moment it applies about the pivot is equal and opposite to the moment applied by the ball 33. The reaction force of the load cell 154 will be equal to the vertical suspension force multiplied by the ratio of the lengths of the moment arm.

In the embodiment described the or each load cell 154 is positioned between a suspension unit 1 and a corner foot 150 but in other embodiments the or each load cell may be positioned between a suspension unit and the suspended assembly. Again a pivot joint or pivot arm similar to that described above may be provided between the suspended assembly and the suspension unit (at the top of the suspension unit), and the or each load sensor is associated with the pivot joint or pivot arm.

Figure 7:
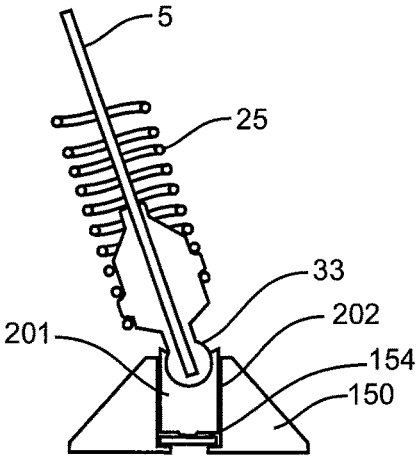
FIG. 7 is a schematic cross section of a suspension unit of another embodiment of the invention.

FIG. 7 is a schematic cross-section of another embodiment. In this embodiment ball 33 at the lower end of suspension unit 1, engages in a socket in the upper end of a piston 201 in a cylinder 202 within foot 150. Non-vertical loads are resisted by the vertical walls of the cylinder and only the vertical load is carried by load cell 154 below the piston. Again, alternatively the load cell 154 may be positioned at the upper end of the suspension unit.

Together the load sensors between all four suspension units and the machine base indicate the vertical forces or vertical component of forces acting between the dynamic parts—the inner bowl and tub assembly—and a static reference point namely the machine cabinet or floor. This equates to the vertical forces being transmitted through the suspension. Alternatively the suspension unit(s) and load sensors may be oriented to indicate force(s) in a non-vertical but defined axis such as an axis at an angle of less than 90 degrees to vertical or an angle of 45 degrees or less to vertical or a horizontal axis for example.

The load sensors measure the forces acting through each suspension unit individually. The load cells are preferably positioned directly under each suspension unit, i.e., between the suspension unit and the cabinet, rather than in the cabinet feet, i.e., between the cabinet and the floor. This provides the most accurate information on the nature of the clothes load and out-of-balance mass. Traditional front loader suspension systems use a combination of tension springs to support the tub from above and dampers attached below. Accurate measurement of forces in these machines would require a load sensor at every connection point—potentially a difficult and expensive arrangement.

In the embodiments described above the drum 103 rotates about a horizontal or approximately horizontal axis (or at an angle of up to 45 degrees from horizontal), i.e., the machine is a horizontal axis machine, but in alternative embodiments the drum 103 may rotate about a vertical axis (or angle of up to 45 degrees from vertical), i.e., the machine may be a vertical axis machine. A horizontal axis machine may be a front or top loading machine. A vertical axis machine is generally top loading.

Figure 2:
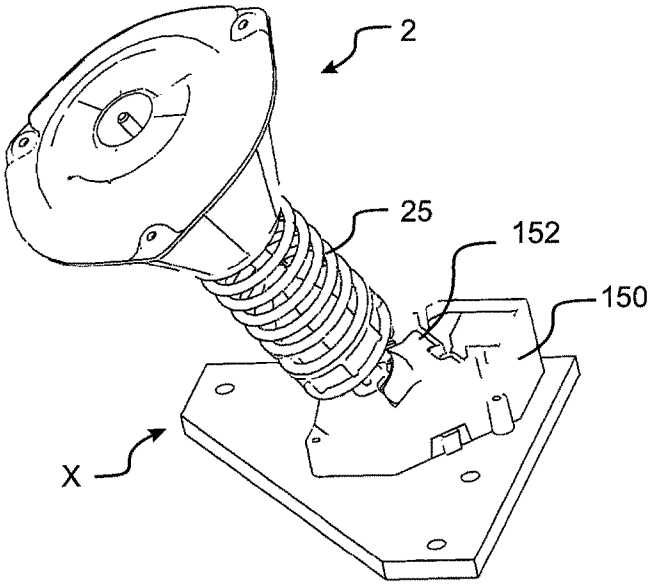
FIG. 2 is a perspective view a suspension unit and foot of one embodiment of the present invention.
Figure 5:
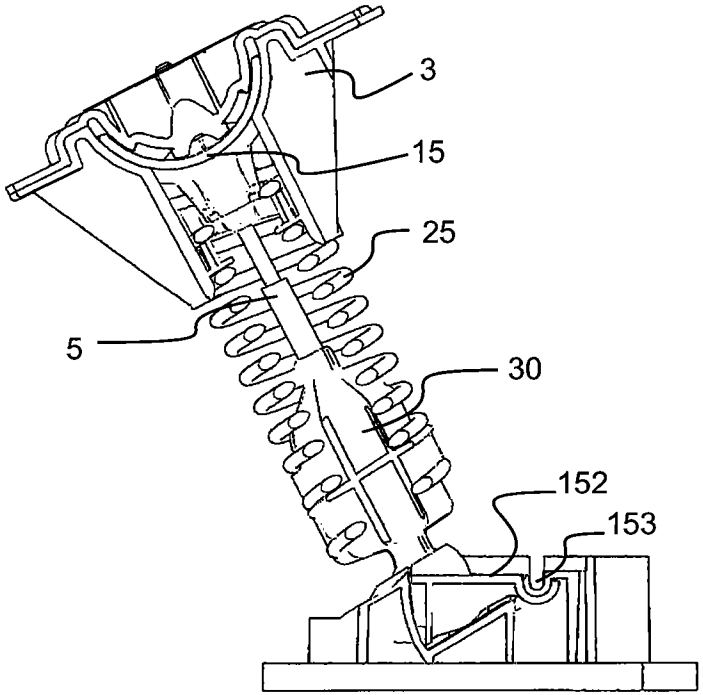
FIG. 5 is a cross section of the suspension unit of FIG. 2 on line RIB-RIB of FIG. 4.
Figure 4:
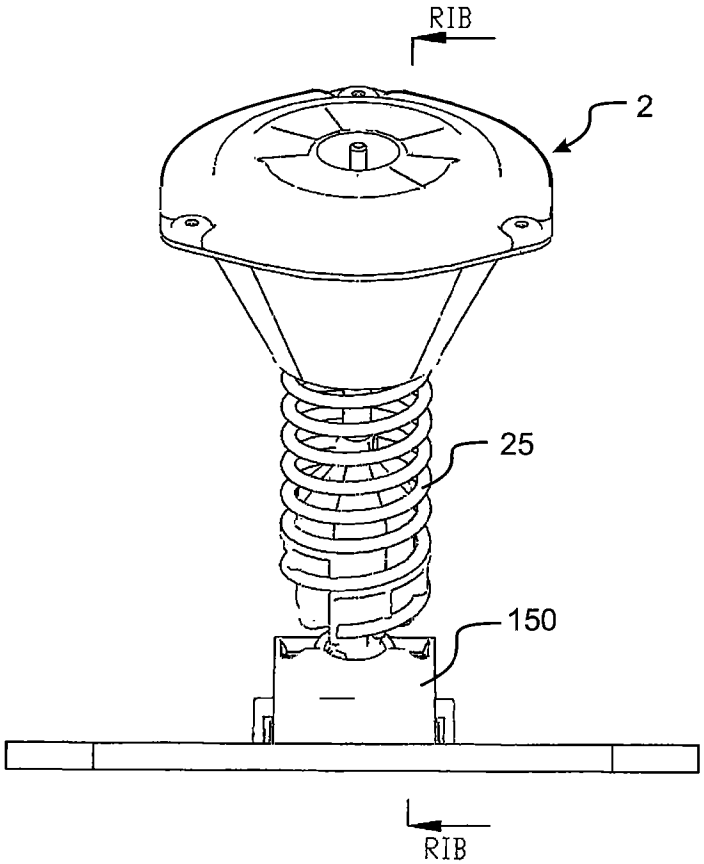
FIG. 4 is a view of the suspension unit and foot of FIG. 2 in the direction of arrow X in FIG. 2.
Figure 6:
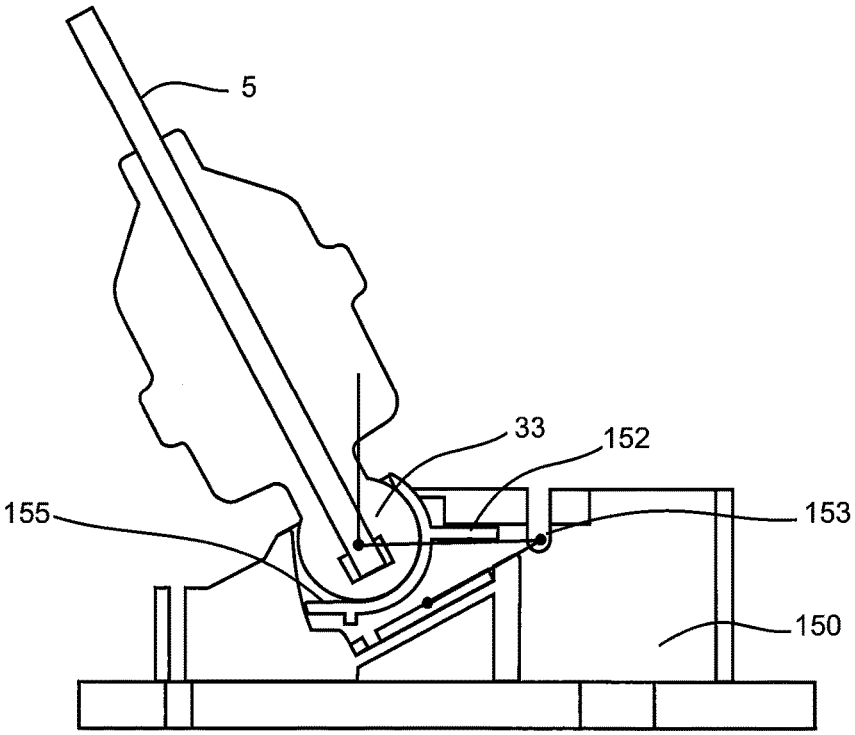
FIG. 6 is a schematic cross section of the suspension unit of FIGS. 2 to 5.
Figure 8:
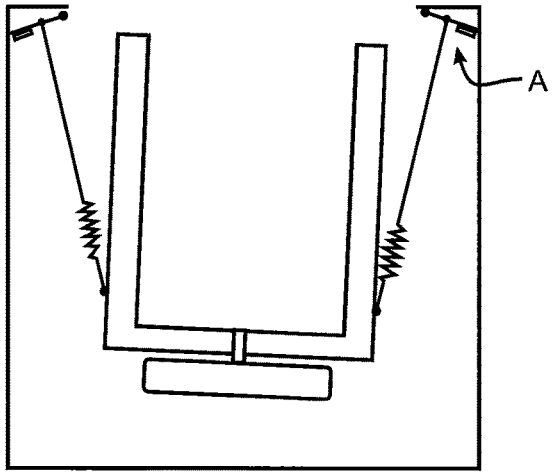
FIG. 8 schematically shows a cabinet and dynamically suspended assembly of a vertical axis washing machine comprising a tub and a drum (not shown) rotationally mounted in the tub, the dynamically suspended assembly supported from above from the cabinet, by four suspension units.

FIG. 8 schematically shows a cabinet and dynamically suspended assembly of a vertical axis washing machine comprising a tub and a perforated drum (not shown) rotationally mounted in the tub, the dynamically suspended assembly supported from above from the cabinet, by four suspension units. A structure largely as described in relation to FIGS. 2 and 7 is provided at location "A" at each corner between an underside of the top of the cabinet and suspension units from which the drum and tub assembly are suspended.

Inner bowls (drums) which have a net out of balance (OOB) mass due to uneven load distribution, transmit forces through the outer bowl assembly (the tub) into the suspension. The OOB forces are dependant on the OOB mass and the rotational speed. The response of the suspension system to OOB force determines how much the inner and outer bowl assembly will displace within the cabinet.

At low speed, when the OOB forces are small, there is negligible displacement due to the suspension dampers. Therefore at low speed, displacement or acceleration sensors have difficulty providing accurate information on the OOB state. In contrast, load cells under the suspension units can provide accurate information on the out-of-balance forces present, before significant displacements occur, and enable corrective action earlier in the spin cycle.

Multiple load sensors can provide information at low speed on the out-of-balance mass and position at each end of the drum. This information can be used by a machine controller to control machine operation. For example:

The load sensors may provide out-of-balance load information during tumbling (40-50 rpm) which is used by the machine controller to choose the best time to transition into spin (higher speed) or otherwise control transition to spin.

The load sensors may provide out-of-balance load information during low speed spin (<120 rpm) which may be used by the machine controller to determine whether to redistribute the clothes load before spinning to higher speeds.

The load sensors may provide information during spin on forces transmitted into the floor which may then be used by the machine controller to control the machine operation to reduce or limit vibration.

The load sensors may provide information near the end of spin, on when water is no longer being extracted, or the current rate of water extraction, which may be used by the machine controller to shorten or otherwise control spin cycle time.

The load sensors may provide information about the load weight (dry and wet) at one or more or all stages in the wash cycle, which may be used by the machine controller to control machine operation and, for example, to estimate detergent requirements and optimal wash cycles and times.

The foregoing description of the invention includes preferred forms thereof. Modifications may be made thereto without departing from the scope of the invention as defined by the accompanying claims.

The invention claimed is:

1. A laundry machine comprising:

a dynamically suspended assembly including a drum for holding laundry, rotationally mounted with the dynamically suspended assembly, a supporting structure for the dynamically suspended assembly, at least one suspension assembly coupled between the dynamically suspended assembly and the supporting structure for supporting the dynamically suspended assembly, a load sensor, and a pivot joint, wherein the pivot joint and load sensor are positioned either:

between a selected suspension assembly and the supporting structure; or between the selected suspension assembly and the dynamically suspended assembly, with the load sensor associated with or positioned at the pivot joint, and wherein an end of the selected suspension assembly comprises a ball mounted in a socket in a pivot arm mounted about an axis to one side of the pivot joint transverse to a compression axis of the suspension assembly.

2. A laundry machine according to claim 1, wherein the load sensor is between the selected suspension assembly and the supporting structure.

3. A laundry machine according to claim 1, wherein the load sensor is responsive substantially only to force in a predetermined direction or a component, in the predetermined direction, of force thereon.

4. A laundry machine according to claim 1, wherein the load sensor is responsive substantially only to vertical force or a vertical component of force thereon.

5. A laundry machine according to claim 1, wherein the pivot joint is a ball joint.

6. A laundry machine according to claim 1, wherein the pivot joint comprises a flexible elastomeric joint element.

7. A laundry machine according to claim 1, comprising at least two suspension assemblies and further comprising at least one additional load sensor, wherein at least two of the suspension assemblies comprise a load sensor, the load sensor of each suspension assembly positioned either between its suspension assembly and the supporting structure or between its suspension assembly and the dynamically suspended assembly.

8. A laundry machine according to claim 7, wherein each of the suspension assemblies comprise a load sensor.

9. A laundry machine according to claim 1, wherein the suspension assembly or assemblies support the dynamically suspended assembly, which includes a drum, from below.

10. A laundry machine according to claim 1, wherein the suspension assembly or assemblies support the dynamically suspended assembly, which includes a drum, from above.

11. A laundry machine according to claim 1, wherein the laundry machine is a horizontal axis washing machine or dryer.

12. A laundry machine according to claim 1, wherein the laundry machine is a vertical axis washing machine or dryer.

* * * * *